US008574382B2

(12) United States Patent
Dragulin et al.

(10) Patent No.: US 8,574,382 B2
(45) Date of Patent: Nov. 5, 2013

(54) HEAT-RESISTANT ALUMINIUM ALLOY

(75) Inventors: Dan Dragulin, Rheinfelden (DE); Rudiger Franke, Lorrach (DE)

(73) Assignee: Aluminium Rheinfelden GmbH, Rheinfelden (DE)

( * ) Notice: Subject to any disclaimer, the term of this patent is extended or adjusted under 35 U.S.C. 154(b) by 1292 days.

(21) Appl. No.: 12/123,830

(22) Filed: May 20, 2008

(65) Prior Publication Data

US 2012/0164021 A1 Jun. 28, 2012

(30) Foreign Application Priority Data

May 24, 2007 (EP) ..... 07405150

(51) Int. Cl.
*C22C 21/02* (2006.01)

(52) U.S. Cl.
USPC ..... 148/439; 420/532; 420/535; 420/549

(58) Field of Classification Search
USPC ..... 148/439, 417; 420/535, 550, 551, 532, 420/549
See application file for complete search history.

(56) References Cited

U.S. PATENT DOCUMENTS

| | | | | |
|---|---|---|---|---|
| 3,306,738 | A * | 2/1967 | MacDonald et al. | 148/438 |
| 3,868,250 | A | 2/1975 | Zimmermann | |
| 4,336,076 | A * | 6/1982 | Edamura et al. | 148/549 |
| 2005/0163647 | A1 | 7/2005 | Donahue et al. | |

FOREIGN PATENT DOCUMENTS

| | | | |
|---|---|---|---|
| CN | 85102454 | A | 4/1986 |
| DE | 10333103 | A1 | 2/2004 |
| EP | 1234893 | A1 | 8/2002 |
| EP | 1645647 | A1 | 4/2006 |
| FR | 2859484 | A1 | 3/2005 |
| JP | 53-115407 | C1 | 10/1978 |
| JP | 1-108339 | A | 4/1989 |
| JP | 10-36933 | A | 2/1998 |
| JP | 11-513439 | A | 11/1999 |
| JP | 2006-322032 | A | 11/2006 |
| RU | 1709746 | C | 10/1994 |
| RU | 2067041 | C1 | 9/1996 |
| SU | 1094377 | A1 | 8/1990 |
| WO | 9615281 | A1 | 3/1996 |
| WO | 97/13882 | A1 | 4/1997 |
| WO | 0043560 | A1 | 7/2000 |
| WO | 00/71772 | A1 | 11/2000 |

OTHER PUBLICATIONS

F.J. Feikus, Optimierung von Aluminum-Silicium-GuBlegierungen für Zylinderköpfe, Höhere Kriechbeständigkeit, Feb. 1999, pp. 50-57, V. 2, ISSN: 0016-9781, Fachverlag Schiele and Schoen GmbH, Markgrafenstrasse 11, Berlin, D-1000, Germany (English Language Abstract attached).

* cited by examiner

*Primary Examiner* — Roy King
*Assistant Examiner* — Janelle Morillo
(74) *Attorney, Agent, or Firm* — The Webb Law Firm

(57) ABSTRACT

A cold-hardening aluminum casting alloy with good thermal stability for the production of thermally and mechanically stressed cast components, wherein the alloy includes
from 11.0 to 12.0 wt % silicon
from 0.7 to 2.0 wt % magnesium
from 0.1 to 1 wt % manganese
less than or equal to 1 wt % iron
less than or equal to 2 wt % copper
less than or equal to 2 wt % nickel
less than or equal to 1 wt % chromium
less than or equal to 1 wt % cobalt
less than or equal to 2 wt % zinc
less than or equal to 0.25 wt % titanium
40 ppm boron
optionally from 80 to 300 ppm strontium
and aluminium as the remainder with further elements and impurities due to production individually at most 0.05 wt %, in total at most 0.2 wt %. The alloy is suitable in particular for the production of cylinder crank cases by the die-casting method.

5 Claims, No Drawings

HEAT-RESISTANT ALUMINIUM ALLOY

The invention relates to a cold-hardening aluminium casting alloy with good thermal stability for the production of thermally and mechanically stressed cast components.

The further development of diesel engines with the aim of improved combustion of the diesel fuel and a higher specific power is leading inter alfa to an increased explosion pressure and consequently to a mechanical stress, acting in a pulsating fashion on the cylinder crank case, which places the most stringent of requirements on the material. Besides a high durability, a high-temperature cycling strength of the material is a further requisite for its use in the production of cylinder crank cases.

AlSi alloys are normally used at present for thermally stressed components, the thermal stability being increased by alloying them with Cu. Copper, however, increases the hot cracking susceptibility and has a detrimental effect on the castability. Applications in which thermal stability is required in particular are encountered primarily in the field of cylinder heads in automotive manufacturing, see for example F. J. Feikus "Optimierung von Aluminium-Silicium-Gusslegierungen far Zylinderköpfe" [Optimization of aluminium-silicon casting alloys for cylinder heads], Giesserei-Praxis, 1999, volume 2, pp. 50-57.

U.S. Pat. No. 3,868,250 discloses a heat-resistant AlMgSi alloy for the production of cylinder heads. Besides the usual additives, the alloy contains from 0.6 to 4.5 wt % Si, from 2.5 to 11 wt % Mg, of which from 1 to 4.5 wt % free Mg, and from 0.6 to 1.8 wt % Mn.

WO-A-9615281 discloses an aluminium alloy having from 3.0 to 6.0 wt % Mg, from 1.4 to 3.5 wt % Si, from 0.5 to 2.0 wt % Mn, at most 0.15 wt % Fe, at most 0.2 wt % Ti, and aluminium as the remainder with further impurities individually at most 0.02 wt %, in total at most 0.2 wt %. The alloy is suitable for components with stringent requirements on the mechanical properties. The alloy is preferably processed by die-casting, thixocasting or thixoforging.

WO-A-0043560 discloses a similar aluminium alloy for the production of safety components by the die-casting, squeeze casting, thixoforming or thixoforging method. The alloy contains 2.5-7.0 wt % Mg, 1.0-3.0 wt % Si, 0.3-0.49 wt % Mn, 0.1-0.3 wt % Cr, at most 0.15 wt % Ti, at most 0.15 wt % Fe, at most 0.00005 wt % Ca, at most 0.00005 wt % Na, at most 0.0002 wt % P, other impurities individually at most 0.02 wt %, and aluminium as the remainder.

A casting alloy of the AlMgSi type known from EP-A-1 234 893 contains from 3.0 to 7.0 wt % Mg, from 1.7 to 3.0 wt % Si, from 0.2 to 0.48 wt % Mn, from 0.15 to 0.35 wt % Fe, at most 0.2 wt % Ti, optionally also from 0.1 to 0.4 wt % Ni and aluminium as the remainder, and impurities due to production individually at most 0.02 wt %, in total at most 0.2 wt %, with the further proviso that magnesium and silicon are present in the alloy essentially in an Mg:Si weight ratio of 1.7:1 corresponding to the composition of the quasi-binary eutectic with the solid phases Al and $Mg_2Si$. The alloy is suitable for the production of safety parts in a vehicle manufacturing by die-casting, rheo- and thixocasting.

EP-A-1 645 647 discloses a cold-hardening casting alloy. The alloy, based on foundry metal with 99.9 Al purity, contains 6-11 wt % Si, 2.0-4.0 wt % Cu, 0.65-1.0 wt % Mn, 0.5-3.5 wt % Zn, at most 0.55 wt % Mg, 0.01-0.04 wt % Sr, at most 0.2 wt % Ti, at most 0.2 wt % Fe and optionally at least one of the elements silver 0.01-0.08, samarium 0.01-1.0, nickel 0.01-0.40, cadmium 0.01-0.30, indium 0.01-0.20 and beryllium up to 0.001 wt %. An alloy specified by way of example has the following composition: Si 9%, Cu 2.7%, Mn 1%, Zn 2%, Sr 0.02%, Mg 0.5%, Fe 0.1%, Ti 0.1%, Ag 0.1%, Ni 0.45%, In 0.1%, Be 0.0005%.

A standardized casting alloy of the type AlSi9Cu3(Fe) is known as alloy 226 (EN AC-46000) with 8-11 wt % Si, at most 1.30 wt % Fe, 2-4 wt % Cu, at most 0.55 wt % Mn, 0.05-0.55 wt % Mg, at most 0.015 wt % Cr, at most 0.55 wt % Ni, at most 1.20 wt % Zn, at most 0.35 wt % Pb, at most 0.25 wt % Sn, at most 0.25 wt % Ti, others individually at most 0.05 wt %, in total at most 0.25 wt %, remainder aluminium.

It is an object of the invention to provide an aluminium alloy having good thermal stability for the production of thermally and mechanically stressed cast components. The alloy is intended to be suitable primarily for die-casting, but also for gravity mould casting, low-pressure mould casting and sand casting.

It is a particular object of the invention to provide an aluminium alloy for cylinder crank cases of combustion engines, in particular diesel engines, produced by the die-casting method.

The components cast from the alloy are intended to have a high strength after cold hardening.

The object is achieved according to the invention in that the alloy contains from 11.0 to 12.0 wt % silicon
from 0.7 to 2.0 wt % magnesium
from 0.1 to 1 wt % manganese
at most 1 wt % iron
at most 2 wt % copper
at most 2 wt % nickel
at most 1 wt % chromium
at most 1 wt % cobalt
at most 2 wt % zinc
at most 0.25 wt % titanium
40 ppm boron
optionally from 80 to 300 ppm strontium and aluminium as the remainder with further elements and impurities due to production individually at most 0.05 wt %, in total at most 0.2 wt %.

A first preferred variant of the alloy according to the invention has the following preferred content ranges for the alloy elements listed below:

from 11.2 to 11.8 wt % silicon
from 0.6 to 0.9 wt % manganese
at most 0.15 wt % iron
from 1.8 to 2.0 wt % magnesium
from 1.8 to 2.0 wt % copper
from 1.8 to 2.0 wt % nickel
from 0.08 to 0.25 wt % titanium
from 20 to 30 ppm boron.

A second preferred variant of the alloy according to the invention has the following preferred content ranges for the alloy elements listed below:

from 11.2 to 11.8 wt % silicon
from 0.6 to 0.9 wt % manganese
at most 0.15 wt % iron, from 1.8 to 2.0 wt % magnesium
from 1.8 to 2.0 wt % copper
from 1.8 to 2.0 wt % nickel
from 0.6 to 1.0 wt % cobalt
from 0.08 to 0.25 wt % titanium
from 20 to 30 ppm boron.

A third preferred variant of the alloy according to the invention has the following preferred content ranges for the alloy elements listed below:
from 11.2 to 11.8 wt % silicon
from 0.6 to 0.9 wt % manganese
at most 0.15 wt % iron
from 0.7 to 1.0 wt % magnesium
from 1.8 to 2.0 wt % copper
from 0.5 to 1.0 wt % chromium
from 1.7 to 2.0 wt % zinc
from 0.08 to 0.25 wt % titanium
from 20 to 30 ppm boron.

The addition of manganese can prevent adhesion of the cast parts in the mould. Manganese also contributes substantially to the thermal hardening. A lower iron content leads to a high elongation and reduces the risk of creating platelets containing Fe, which lead to increased cavitation and impair the mechanical processability.

The high Si content leads to a very good castability and to reduction of the cavitation. The near-eutectic Al—Si composition also makes it possible to reduce the casting temperature and therefore extend the lifetime of a metal mould. The hypo-eutectic Si level has been selected so that no primary Si crystals occur.

By adding chromium, the mould release behaviour of the alloy can be improved further and the strength values can be increased. Cobalt serves to increase the thermal stability. Titanium and boron serve for grain refining. Good grain refining contributes substantially to improving the casting properties and the mechanical properties.

A preferred field of application for the aluminium alloy according to the invention is the production of thermally and mechanically stressed cast components as die, mould or sand castings, in particular for cylinder crank cases in automotive manufacturing produced by the die-casting method.

Other advantages, features and details of the invention may be found in the following description of preferred exemplary embodiments.

The alloys according to the invention were cast by the die-casting method to form flat tensile specimens with a wall thickness of 3 mm. After removal from the die-casting mould, the specimens were cooled in still air.

The mechanical properties yield point (Rp0.2), tensile strength (Rm) and elongation at break (A) were determined for the tensile specimens in the cast state at room temperature (RT), 150° C., 225° C. and 300° C., and also at room temperature (RT) and at the heat treatment temperature (HTT) after various one-stage heat treatments respectively for 500 hours at 150° C., 225° C. and 300° C.

The alloys studied are collated in Table 1.

Tables 2, 3 and 4 report the results of the mechanical properties determined for tensile specimens of the alloys of Table 1 in the cast state at various temperatures.

Tables 5, 6 and 7 report the results of the mechanical properties determined at room temperature (RT) and at the heat treatment temperature (HTT) for tensile specimens of the alloys of Table 1 after a heat treatment for 500 hours at various temperatures.

The results of the long-term tests confirm the good thermal stability of the alloy according to the invention.

TABLE 1

Chemical composition of the alloys in wt %

| Alloy | Si | Mg | Mn | Fe | Cu | Ni | Cr | Co | Zn | Ti |
|---|---|---|---|---|---|---|---|---|---|---|
| AlSi11Mg2Cu2Ni2 | 11.5 | 2.0 | 0.7 | 0.1 | 2.0 | 2.0 | | | | 0.19 |
| AlSi11Mg2Cu2Ni2Co | 11.7 | 1.9 | 0.7 | 0.1 | 1.9 | 1.9 | | 0.9 | | 0.18 |
| AlSi11Mg1Cu2Cr1Zn2 | 11.6 | 0.9 | 0.7 | 0.1 | 2.0 | | 0.7 | | 2.0 | 0.15 |

TABLE 2

Yield point (Rp0.2) at different temperatures

| | Rp0.2 [MPa] | | | |
|---|---|---|---|---|
| Alloy | RT | 150° C. | 225° C. | 300° C. |
| AlSi11Mg2Cu2Ni2 | 300 | 315 | 243 | 117 |
| AlSi11Mg2Cu2Ni2Co | 300 | 320 | 254 | 124 |
| AlSi11Mg1Cu2Cr1Zn2 | 250 | 260 | 210 | 97 |

TABLE 3

Tensile strength (Rm) at different temperatures

| | Rm [MPa] | | | |
|---|---|---|---|---|
| Alloy | RT | 150° C. | 225° C. | 300° C. |
| AlSi11Mg2Cu2Ni2 | 320 | 350 | 280 | 160 |
| AlSi11Mg2Cu2Ni2Co | 349 | 340 | 290 | 180 |
| AlSi11Mg1Cu2Cr1Zn2 | 370 | 340 | 240 | 120 |

TABLE 4

Elongation at break (A) at different temperatures

| | A [%] | | | |
|---|---|---|---|---|
| Alloy | RT | 150° C. | 225° C. | 300° C. |
| AlSi11Mg2Cu2Ni2 | 0.3 | 0.6 | 1.2 | 10.7 |
| AlSi11Mg2Cu2Ni2Co | 0.4 | 0.4 | 0.8 | 7 |
| AlSi11Mg1Cu2Cr1Zn2 | 2 | 3.6 | 8.1 | 48 |

TABLE 5

Yield point (Rp0.2) after 500 h heat treatment at different temperatures, testing at RT and at HTT

| | Rp0.2 [MPa] | | | | | |
|---|---|---|---|---|---|---|
| Alloy | 150° C. RT | 225° C. RT | 300° C. RT | 150° C. HTT | 225° C. HTT | 300° C. HTT |
| AlSi11Mg2Cu2Ni2 | 300 | 200 | 110 | 310 | 150 | 55 |
| AlSi11Mg1Cu2Cr1Zn2 | 300 | 175 | 100 | 275 | 135 | 50 |

TABLE 6

Tensile strength (Rm) after 500 h heat treatment at different temperatures, testing at RT and at HTT

| | Rm [MPa] | | | | | |
|---|---|---|---|---|---|---|
| Alloy | 150° C. RT | 225° C. RT | 300° C. RT | 150° C. HTT | 225° C. HTT | 300° C. HTT |
| AlSi11Mg2Cu2Ni2 | 310 | 270 | 250 | 330 | 220 | 105 |
| AlSi11Mg1Cu2Cr1Zn2 | 380 | 300 | 230 | 325 | 180 | 70 |

TABLE 7

Elongation at break (A) after 500 h heat treatment at different temperatures, testing at RT and at HTT

| | A [%] | | | | | |
|---|---|---|---|---|---|---|
| Alloy | 150° C. RT | 225° C. RT | 300° C. RT | 150° C. HTT | 225° C. HTT | 300° C. HTT |
| AlSi11Mg2Cu2Ni2 | 0.2 | 0.7 | 3.1 | 0.4 | 1.8 | 32 |
| AlSi11Mg1Cu2Cr1Zn2 | 1.3 | 2.9 | 4.7 | 2.7 | 12 | 63 |

The invention claimed is:

1. A cold-hardening aluminium casting alloy for the production of thermally and mechanically stressed cast components, said alloy comprising:

from 11.2 to 11.8 wt % silicon,
from 0.6 to 0.9 wt % manganese,
less than or equal to 0.15 wt % iron,
from 0.7 to 1.0 wt % magnesium,
from 1.8 to 2.0 wt % copper,
from 0.5 to 1.0 wt % chromium,
from 1.7 to 2.0 wt % zinc,
from 0.08 to 0.25 wt % titanium,
from 20 to 30 ppm boron,
less than or equal to 2 wt % nickel,
less than or equal to 1 wt % cobalt,
optionally from 80 to 300 ppm strontium,
and aluminium as the remainder with further elements and impurities due to production individually at most 0.05 wt %, in total at most 0.2 wt %.

2. An aluminium alloy according to claim 1 for thermally and mechanically stressed cast components produced by a die-casting, mould casting or sand casting method.

3. The aluminium alloy according to claim 2 for cylinder crank cases in automotive manufacturing produced by the die-casting method.

4. An aluminium alloy according to claim 1 for safety parts in automotive manufacturing produced by a die-casting method.

5. A cast component made of a cold-hardening aluminium casting alloy according to claim 1.

* * * * *